US011517489B2

(12) United States Patent
Isik

(10) Patent No.: US 11,517,489 B2
(45) Date of Patent: Dec. 6, 2022

(54) DEVICES FOR THE DISCHARGE OF BODILY WASTES

(71) Applicant: Hasan Hueseyin Isik, Wil SG (CH)

(72) Inventor: Hasan Hueseyin Isik, Wil SG (CH)

( * ) Notice: Subject to any disclaimer, the term of this patent is extended or adjusted under 35 U.S.C. 154(b) by 0 days.

(21) Appl. No.: 17/071,328

(22) Filed: Oct. 15, 2020

(65) Prior Publication Data

US 2021/0069043 A1 Mar. 11, 2021

Related U.S. Application Data

(63) Continuation-in-part of application No. 17/046,112, filed as application No. PCT/CH2019/000012 on Apr. 11, 2019.

(30) Foreign Application Priority Data

Apr. 12, 2018 (CH) ..... 00466/18

(51) Int. Cl.
*A61G 9/00* (2006.01)

(52) U.S. Cl.
CPC ..... *A61G 9/003* (2013.01)

(58) Field of Classification Search
CPC ..... A61G 9/003; A61G 9/006
See application file for complete search history.

(56) References Cited

U.S. PATENT DOCUMENTS

| | | | | |
|---|---|---|---|---|
| 183,973 A | | 10/1876 | Rhodes | |
| 1,779,742 A | | 10/1930 | Lines | |
| 2,384,325 A | * | 9/1945 | Marsan | A61G 7/02 5/604 |
| 2,654,898 A | | 10/1953 | Eckart et al. | |
| 2,971,204 A | | 2/1961 | McCoy et al. | |
| 3,329,104 A | | 7/1967 | Gittings | |
| 3,345,652 A | | 10/1967 | Hiraga | |
| 3,922,735 A | * | 12/1975 | Kato | A61G 7/02 5/605 |
| 5,737,786 A | * | 4/1998 | Yamamoto | A61G 7/0005 5/616 |
| 6,651,267 B1 | | 11/2003 | Utz | |

FOREIGN PATENT DOCUMENTS

| | | | |
|---|---|---|---|
| CA | 2394796 | A1 | 5/2001 |
| CH | 714896 | A2 | 10/2019 |
| DE | 19916283 | A1 | 10/2000 |
| DE | 10103910 | B4 | 9/2004 |
| FR | 2724841 | A1 | 3/1996 |
| WO | 01/37775 | A1 | 5/2001 |
| WO | 2019/195950 | A1 | 10/2019 |

OTHER PUBLICATIONS

PCT ISR and written opinion, dated May 29, 2019, from parent PCT—international appl. PCT/CH2019/000012 published as WO2019/195950A1, English translations as provided by WIPO.

* cited by examiner

*Primary Examiner* — Robert G Santos
*Assistant Examiner* — Adam C Ortiz

(57) ABSTRACT

Devices for the discharge of bodily waste, in particular for the soiling-free discharge of bodily waste from a person situated on a bed or a seat. A bed's mattress (2) is provided with a slot (4) that may be opened and closed, and which extends continuously through the thickness of the mattress (2). The slot is controllably openable and closable via an actuated mechanism that may be power driven. Hygienic elimination of bodily waste while lying down or sitting may be achieved with little effort.

9 Claims, 7 Drawing Sheets

DEVICES FOR THE DISCHARGE OF BODILY WASTES

CROSS-REFERENCE TO RELATED APPLICATIONS

This application is a continuation-in-part (CIP) of copending prior U.S. application Ser. No. 17/046,112 which is a 35 U.S.C. 371 national-phase entry of PCT International application no. PCT/CH2019/000012 filed on Apr. 11, 2019 and also claims benefit of priority to prior Swiss national application no. CH 00466/18 filed on Apr. 12, 2018, and the entirety of parent U.S. application Ser. No. 17/046,112 is hereby expressly incorporated herein by reference, in its entirety and as to all its parts, for all intents and purposes, as if set forth identically in full herein.

BACKGROUND

The present disclosure pertains to devices for the discharge of bodily wastes, in particular for the soiling-free discharge of urine from a person situated on a bed or a seat.

Soilings via splashing can occur during so-called standing urination, in particular as practiced by men. Hence, various urination aids such as, for example, tubular or tube-like urination aids according to DE 19916283A1 or DE 10103910B4, have already been proposed that are to enable a splash-free drainage of urine, also for women, into a toilet.

In addition, even in the case of restricted mobility of the persons concerned, a urination or a defecation may be merely limited and/or may not be free of contamination. This is the case with bedridden persons in hospitals or nursing homes who are dependent on aids, such as sliders or bed pans, and on the support of third parties. This is uncomfortable for the persons concerned, and without the assistance of third parties, contamination of the bed may occur, giving rise to additional cleaning and maintenance expenditures.

SUMMARY

It is within the scope of the present disclosure therefore to create devices for discharging urine that permit hygienic urination with little effort while lying or sitting.

This object may be achieved within the scope of the present disclosure.

According to the present disclosure, a bed, in particular a bed's mattress, is provided with a slot that extends end-to-end continuously through the thickness of the mattress. An insert is arranged in the region of the slot. The slot can be expanded manually or by means of a clamping arrangement, so that the insert may be accordingly removed and inserted with little effort.

For a very low-force operation, a clamping arrangement is advantageously installed on or under the insert in the slot.

Further advantageous versions are disclosed within the scope of the present disclosure.

So, for example, the clamping arrangement may be designed in the form of a clamping frame structure, or plates that can move relative to one another.

Besides a contamination-free discharge of the urine, the device according to the invention makes possible a hygienic and odorless storage of same until disposal.

A device within the scope of the present disclosure is particularly suitable for men's urination, but may also be adapted to the physical conditions of women.

BRIEF DESCRIPTION OF THE DRAWINGS

Examples are described more closely below via exemplary embodiments with reference to the following drawings.

DETAILED DESCRIPTION

Figure 1:
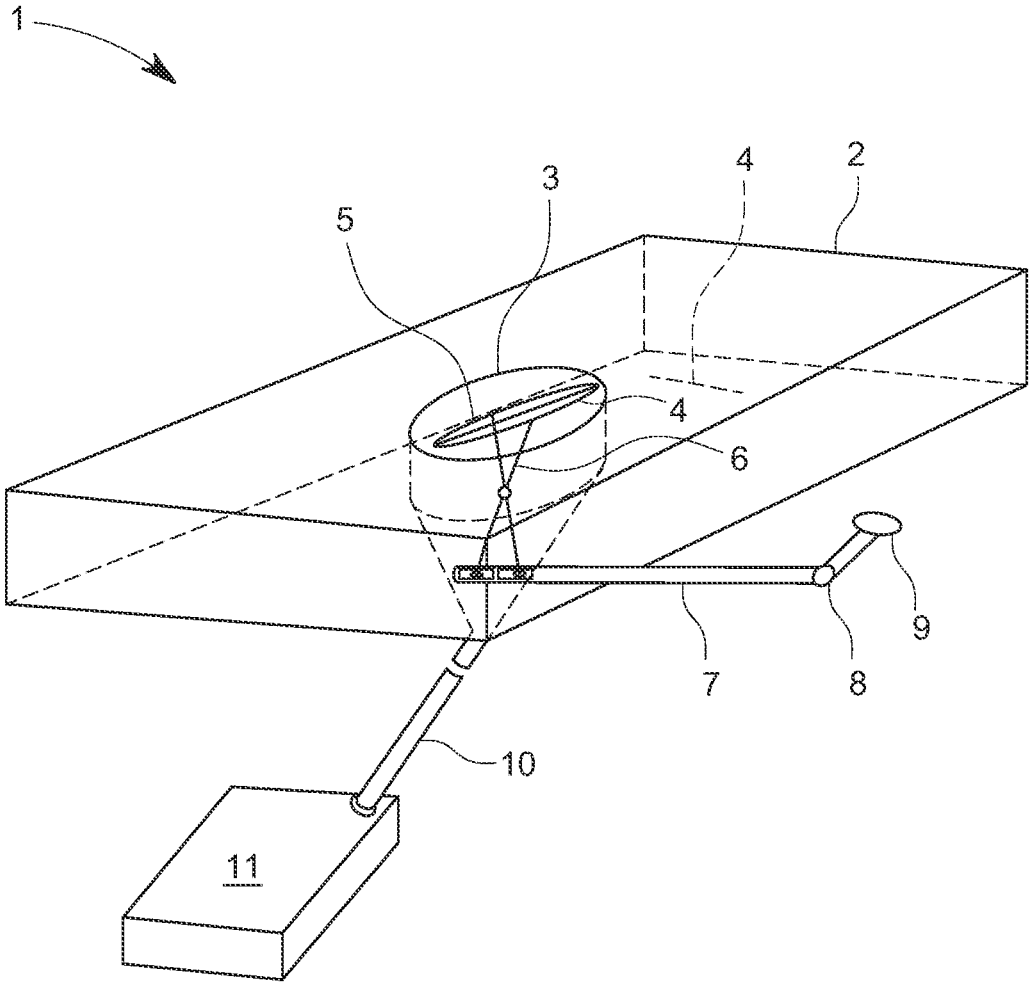
FIG. 1—depicts an exemplary device, utilizing the example of a bed.

A normal bed 1 is equipped with a mattress 2 that, in the area of the lower abdomen, is provided with a slot 4 that may be opened and closed elastically and which extends continuously over the thickness of the mattress 2, running parallel to the longitudinal sides of the mattress 2; and which is approximately the same distance from the longitudinal sides of the mattress 2. The slot 4 preferably has a length of at least 20 cm and can be opened/widened at least 5 cm. In the Figure, this slot 4 is depicted simplified in closed state with side walls lying against one another.

The mattress 2 is covered with a sheet that is also cut open in the area of the slot 4, and the mattress 2 is provided with an insert 3 made of eudermic (skin-friendly), water-repellent and easily cleanable material in the region of the slot 4. The insert 3 also extends along the side walls of the slot 4 down to the bottom of the mattress 2. The insert 3 may be a part of the sheet or applied to it, or rather be introduced into the slot 4, as a separate element. In addition, the mattress 2 may have a trough depression in the direction of the slot 4.

Alternatively or in addition, the mattress 2 may also be provided with a slot that is arranged closer to a long side of the mattress 2 and that runs approximately parallel to the narrow sides of the mattress 2, as indicated in FIG. 1.

At the slot 4, there is arranged on or below the insert 3 a clamping frame structure 5 that is connected to a scissors mechanism 6 extending outside/beyond the underside of the mattress.

The clamping frame structure 5 and the scissors mechanism 6 are preferably made of a corrosion-resistant material, for example a light metal or a resilient plastic.

The clamping frame structure 5 may also be designed in the form of tongs or in some other way. Regardless of the form of structure, it must be able to widen the slot when the scissors mechanism 6 is actuated.

Likewise, instead of the scissors mechanism 6, a gear tooth segment may be employed, or a folding membrane that opens when pressure is applied may be arranged in the slot 4.

The lever ends of the scissors mechanism 6 opposite to the clamping frame structure 5 are coupled to a lever 7 (pull rod, pull cable, etc.), the other end of which is provided with a joint 8 that is in operative connection with a handle 9. Through that is rendered possible opening and closing movement of the scissors mechanism 6, or rather the clamping frame structure 5, as shown in the Figure. During an opening movement of the clamping frame structure 5, the material of the mattress is pushed aside at the slot 4 and an open area is formed.

Instead of the clamping frame structure, the clamping arrangement may also be designed in the form of plates 26 arranged hinge-connected on one side. In closed state they lie against one another and can be opened in a V-shape by means of, for example, a rotatable rod.

Figure 2:
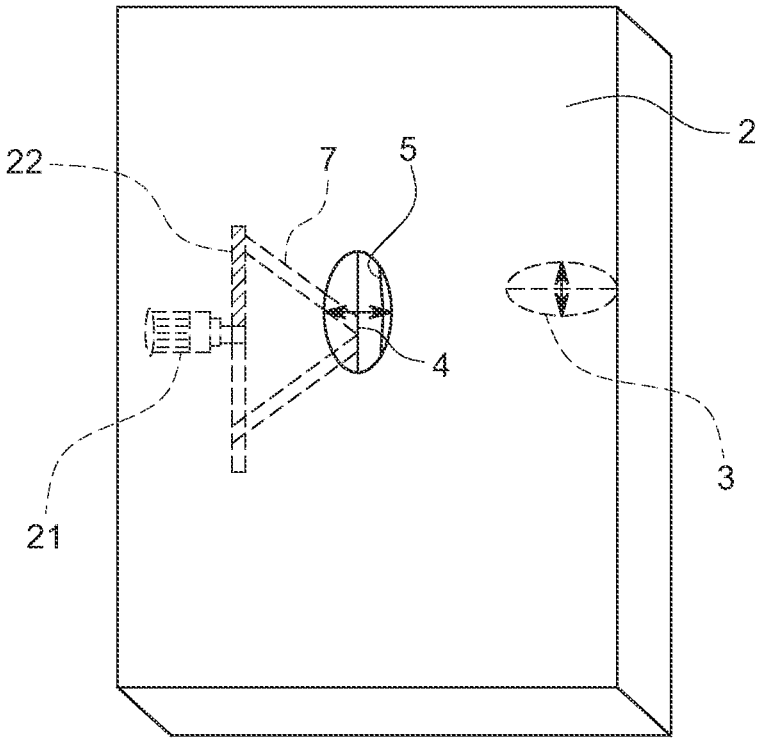
FIG. 2—depicts an exemplary device including a drive motor, utilizing the example of a bed.

In another version, the two plates can also be arranged movable relative to one another and moved by means of cylinder or screw drive, but without an articulated connection to one another. With reference to FIG. 2, a slot 4 is likewise disposed in a mattress 2 as depicted. The slot 4, as depicted, may be parallel to the longer sides of the mattress, or perpendicular to the longer sides of the mattress as depicted to the right in phantom/broken-line sketch. In this version, a drive motor 21 controllably reciprocates a rack or linear gear 22 that carries at one of its ends a pivotable lever rod 7. This pivotable lever rod 7 has a distal end located proximately below the slot 4 of the mattress 2. As more analytically depicted in FIG. 3, two prongs 20 of a fork extend upwards from the distal end of the pivotable lever rod 7 so as to each, respectively, connect with a respective one of the two sides of the slot 4 via the plates 26 or clamping frame structure 5.

Figure 3:
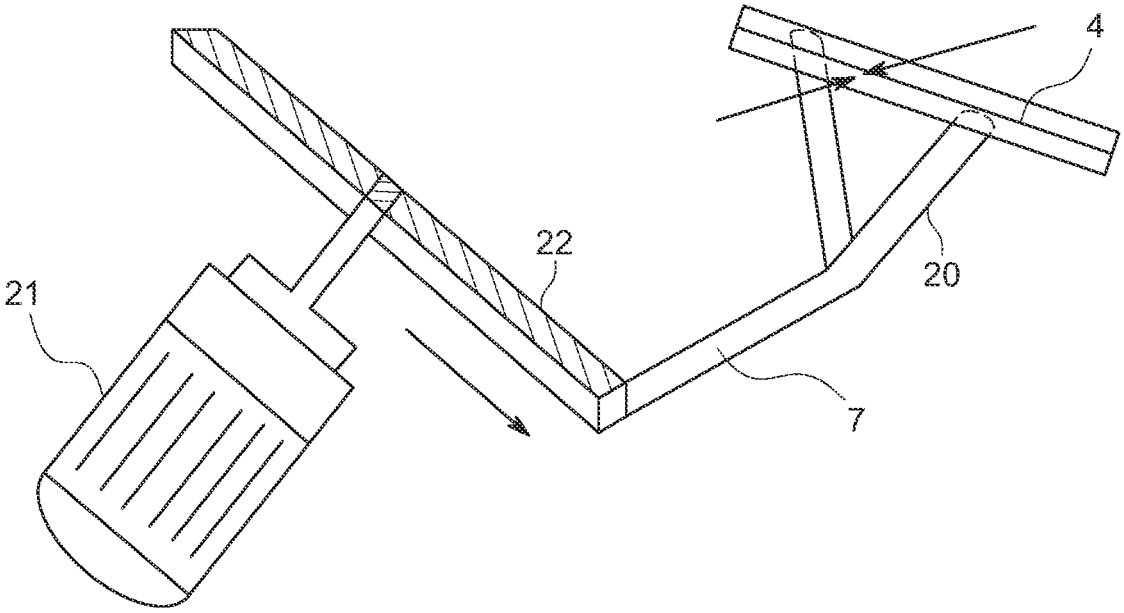
FIG. 3—depicts a drive arrangement of the exemplary device of FIG. 2 closing the slot 4.
Figure 4:
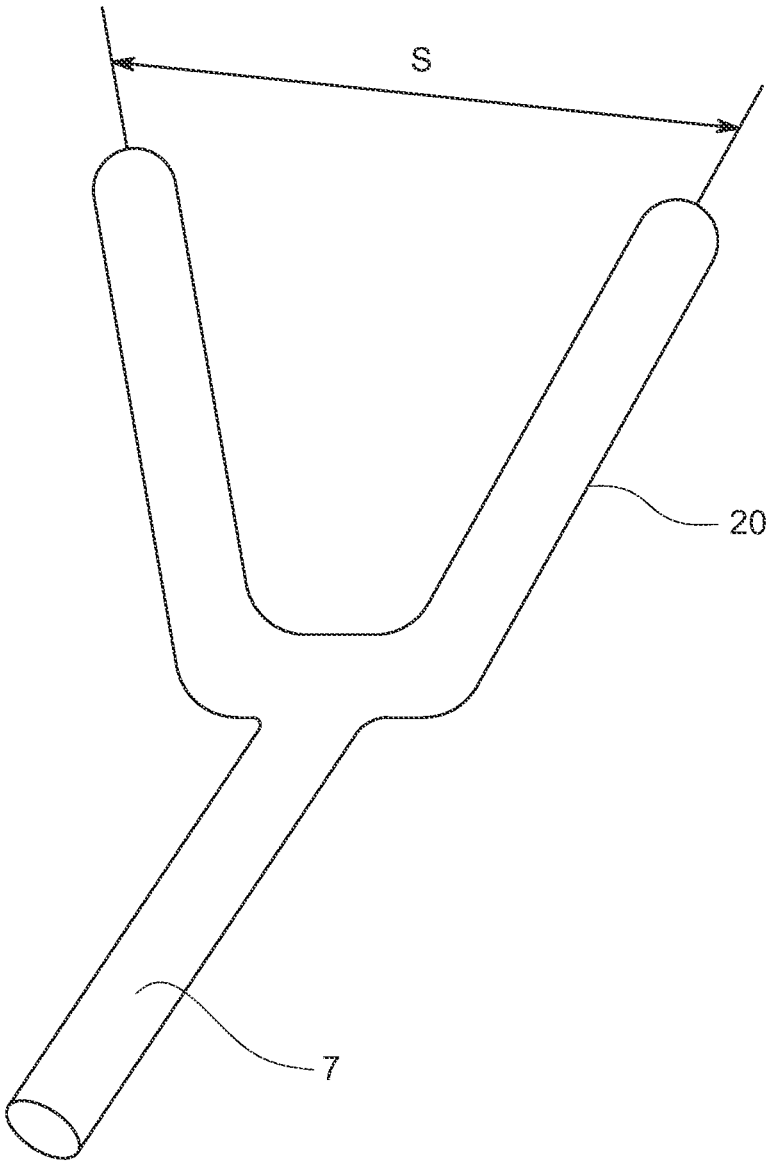
FIG. 4—depicts an alternative fork for the drive arrangement of FIG. 3.

While the fork prongs as depicted in FIG. 3 form a V-shape with vertex at the distal end of the pivotable lever rod 7, it should be understood that alternative fork prongs 20, for example upright legs of a U-shaped fork as depicted in FIG. 4, may possibly be employed, and thus the V-shape is an exemplary version.

With reference to FIGS. 2-3, a reciprocation of the rack or linear gear 22 in the direction of the arrow of FIG. 3 brings the span S across the tips of the two prongs 20 of the actuation fork towards alignment with the axis of the slot 4, bringing the two sides of the slot 4 towards each other, as indicated by the arrows in FIG. 3, to controllably close the slot 4 and clamping frame structure 5.

Figure 5:
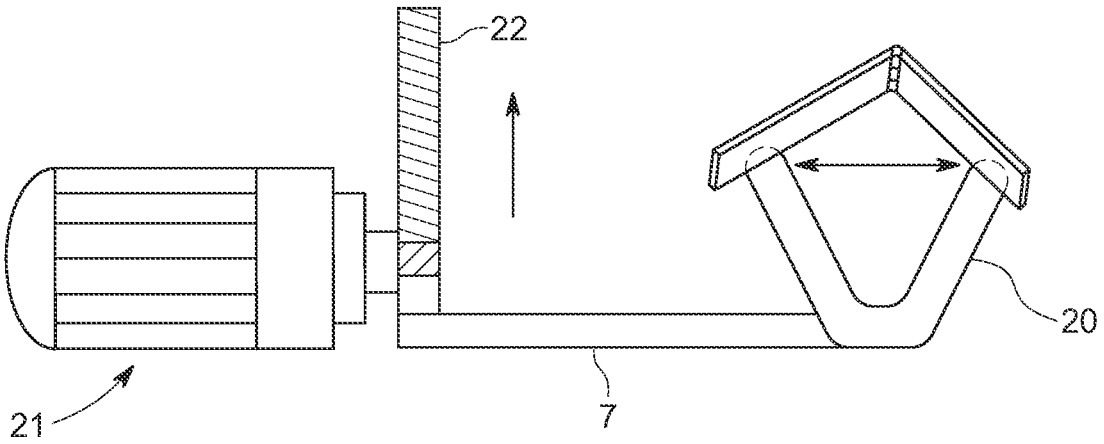
FIG. 5—depicts a drive arrangement of the exemplary device of FIG. 2 opening the slot 4.

With reference to FIG. 5, conversely, when reciprocation of the rack or linear gear 22 in the direction of the arrow of FIG. 5 brings the span S across the tips of the two prongs 20 of the actuation fork closer to perpendicular relative to the axis of the slot 4, the two sides of the slot 4 are pulled into separation to controllably open the slot 4 and the clamping frame structure. FIG. 5 also references and depicts the possibility wherein the clamping arrangement may also be designed in the form of plates 26 arranged mutually hinge-connected each on one of its respective sides. In closed state they lie against one another and can be opened in a V-shape via a similar actuation by actuation fork prongs 20. Artisans of ordinary skill in the art shall consequently immediately understand from the aforegoing description that an efficient mechanism for controllably opening and closing the mattress slot 4 is presented by a pivotable lever rod 7 having a distal end to which a fork with prongs 20 is connected, and that this efficient mechanism presents a range of readily adaptable options for implementation by selection of the relative angle between the axis of the pivotable lever rod 7 and the linear segment span S across prongs 20. This makes the slot operating mechanism easily adaptable to a large range of size and location constraints across a large range of supporting surface types and sizes. Furthermore, diverse types of motors may be employed to drive the rack or linear gear 22.

Figure 7:
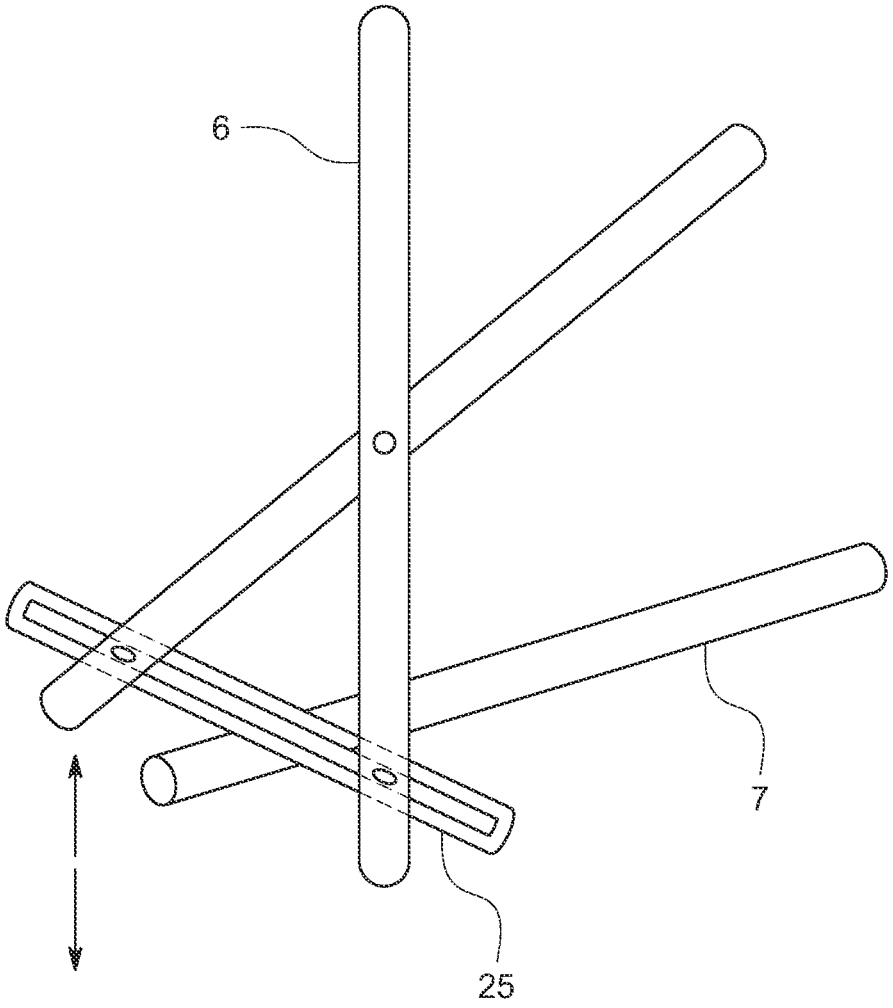
FIG. 7—depicts a scissors mechanism base link in relation to pivotable lever rod 7.

With renewed reference to FIG. 2, it is also possible to constrain the pivotable lever rod 7 so that its distal end is forced to rise beneath the slot 4 towards the mattress 2 when the drive motor 21 controllably reciprocates the rack or linear gear 22, for example in the direction indicated by the arrow of FIG. 5, carrying the pivotable lever rod 7 and consequently moving the lever rod 7 axis relative to the slot 4 axis. In this case, the controllable elevation and lowering of the distal end of the pivotable lever rod 7 below the slot 4 may be employed to operate a scissors mechanism 6 having a non-pivoting base link 25, indicated in FIG. 7, for the scissors arms, in a similar manner previously discussed herein with referral to FIG. 1.

In this manner, the scissors mechanism 6, possibly including the lever 7, may also be motor operated, in which case particularly electric drives or pneumatic drives succeed in application. The scissors mechanism 6 may preferably be opened or closed by means of a left-right switching movement. The drive can, for example, be activated by means of a wire-connected sensor, wirelessly using gesture control or by means of an App.

Figure 6:
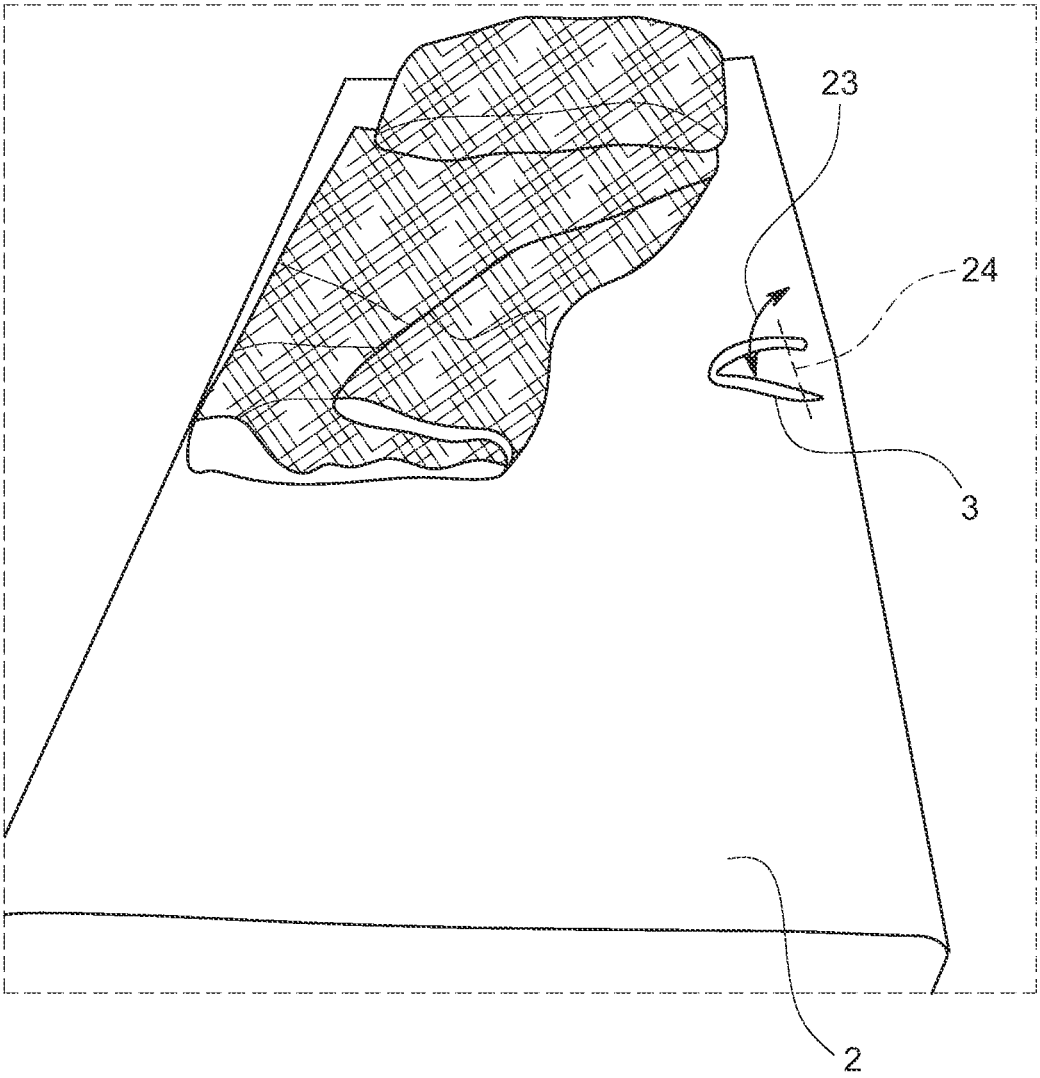
FIG. 6—depicts another version of a device, utilizing the example of a bed as FIG. 1.

FIG. 6 depicts an alternative version in which a mattress 2 is provided with an insert 3 capped by a triangular bed insert cover openable as indicated. In this version, when discharge of bodily wastes through insert 3 is desired, the triangular bed insert cover is pivoted around an axis 24 upwards in the direction of arc 23, thereby opening the insert to receive bodily waste. At completion, the triangular bed insert cover is pivoted downwards in the direction of arc 23 to close the open area of the insert 3. The opening of the triangular bed insert cover may be made by a manually operated mechanism or by a controllable, power-driven mechanism.

It is also possible, in a simplified embodiment, to dispense with clamping elements and rather to manually widen the slot 4 and correspondingly also to manually manipulate the insert 3.

The slot 4 descends to the underside or below the mattress 2 in liquid- and odor-tight manner into a conduit 10, for example a hose, to a tank 11 for collection of urine, and, as the case may be, feces. In order to be completely emptied, the conduit 10 is placed sufficiently sloped.

Instead of the slot, simply a permanent opening (round or oval) with an insert part (manually driven or motor driven) could be provided.

For use of the exemplary device according to the present disclosure, the person lying in bed 1 must operate the handle 9 in such a way that by means of the scissors mechanism 6 slot 4 is opened to such an extent that, for example, a penis can be placed above or therein so that the person can release bodily waste exclusively and splash-free into slot 4.

In another version a flap (not depicted) at the connection between the line 10 and the tank 11 is opened at the same time with the actuation of the handle 9, so that all urine enters the tank 11 and no liquid remains in the line. After completion of the procedure, this flap is closed again manually or after a preset time.

The closed slot 4 intrinsically already functions as an odor trap.

For disinfection/drying of the exemplary device, in particular the clamping arrangement, UV light and/or a disinfectant spray may be introduced into the slot or the insert part. This can be carried out manually or by means of a sensor responding to the open position and/or humidity.

The person or a third party can empty and clean the tank 11 at necessary time intervals.

The device according to the present disclosure may also be arranged in a seat or in the region of a front edge of a chair or driver's seat, in fashion adapted to the seat. Thus, elimination of bodily waste is possible while sitting, or for drivers, during driving or in a traffic jam.

In closing, it should be noted that the above description is intended to illustrate rather than limit the invention, and that readers skilled in the technological art shall be capable of designing alternative embodiments without departing from the protected scope of invention as set forth by the appended claims. As equivalent elements or steps can be substituted for elements or steps employed in claimed invention so as to obtain substantially the same results in substantially the same way, the protected scope of the present invention is defined by the appended claims, including known equivalents and unforeseeable equivalents at the time of filing of this application. Furthermore, in the following claims, the verb 'comprise' and its conjugations do not exclude the presence of elements or steps other than those listed in any claim or the specification as a whole. The singular reference of an element does not necessarily exclude the plural reference of such elements and vice-versa. The mere fact that certain elements or steps may be recited in mutually different dependent claims does not necessarily indicate that a combination of these elements or steps cannot possibly be used to advantage.

List of Reference Labels

1—bed
2—mattress
3—insert
4—slot
5—clamping frame structure
6—scissors mechanism
7—lever
8—joint
9—handle
10—conduit
11—tank
20—actuation fork prong
21—electric drive
22—rack/linear gear
23—arcuate direction
24—pivot axis
25—base link for scissor arms of scissors mechanism 6
26—plates
S—span (linear segment) across tips of actuation fork prongs 20

What is claimed is:

1. A device for discharging bodily waste, the device comprising:

a body-supporting mattress, said mattress having a thickness, said mattress having a first, body-supporting side, said mattress having a second, lower side;

a controllably openable and closable slot provided in said body-supporting mattress, said slot extending through the thickness of said mattress end-to-end from said mattress first side to said mattress second side, said slot having at least two slot sides;

an insert, said insert being arranged in a region of said slot;

a clamping frame structure disposed at said slot;

relatively movable clamping plates provided at said clamping frame structure;

an actuation fork operatively connected to said clamping frame structure;

a pivotable lever rod connected to said actuation fork, said pivotable lever rod being carried by a controllably reciprocating rack; and, a drive motor operatively connected to controllably reciprocate said rack.

2. A device for discharging bodily waste as claimed in claim 1, the device further comprising:

two prongs formed as parts of said actuation fork.

3. The device for discharging bodily waste as claimed in claim 2, wherein:

said prongs are operatively connected each respectively to a different one of said slot sides.

4. The device for discharging bodily waste as claimed in claim 1, wherein:

said clamping frame structure includes two plates arranged mutually hinge-connected.

5. A device for discharging bodily waste as claimed in claim 4, the device further comprising:

two prongs formed as parts of said actuation fork.

6. The device for discharging bodily waste as claimed in claim 5, wherein:

said prongs are operatively connected each respectively to a different one of said two plates.

7. A device for discharging bodily waste as claimed in claim 1, the device further comprising:

a conduit in operative communication with said slot, said conduit extending below said second, lower side.

8. A device for discharging bodily waste as claimed in claim 7, the device further comprising:

a tank connected to said conduit.

9. A device for discharging bodily waste as claimed in claim 1, the device further comprising:

at least one lateral side of said mattress, said slot being formed to extend approximately parallel to said at least one lateral side of said mattress.

* * * * *